US006897638B2

(12) United States Patent
Miyanaga et al.

(10) Patent No.: US 6,897,638 B2
(45) Date of Patent: May 24, 2005

(54) STABILIZED POWER SUPPLY UNIT HAVING A CURRENT LIMITING FUNCTION

(75) Inventors: Koichi Miyanaga, Kyoto (JP); Hiroyuki Ishikawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 141 days.

(21) Appl. No.: 10/613,858

(22) Filed: Jul. 2, 2003

(65) Prior Publication Data

US 2004/0004466 A1 Jan. 8, 2004

(30) Foreign Application Priority Data

Jul. 8, 2002 (JP) ..... 2002-198280

(51) Int. Cl.[7] ..... G05F 1/573
(52) U.S. Cl. ..... 323/274; 323/277; 323/908
(58) Field of Search ..... 323/273, 274, 323/275, 276, 277, 908

(56) References Cited

U.S. PATENT DOCUMENTS 4,731,574 A * 3/1988 Melbert ..... 323/275
4,814,687 A * 3/1989 Walker ..... 323/275
5,747,975 A * 5/1998 Colandrea et al. ..... 323/276
6,246,555 B1 * 6/2001 Tham ..... 361/18
6,806,692 B2 * 10/2004 Lee ..... 323/277

* cited by examiner

*Primary Examiner*—Jeffrey Sterrett
(74) *Attorney, Agent, or Firm*—Hogan & Hartson LLP

(57) ABSTRACT

In a stabilized power supply unit having a current limiting function, the unit is designed to have a steep over-current dropping characteristic. This minimizes the over-current region, prevents oscillation during a startup, and limits inrush current during a start up within a predetermined range. The output voltage of the power supply unit provides a constant output voltage by controlling an output transistor by means of a differential amplifier amplifying the difference between a reference voltage and an output feedback voltage. The power supply unit has a first high-gain, slow-response type current limiting circuit that outputs a first current limiting signal when the output current of the power supply unit exceeds a predetermined level, and a second low-gain, quick-response type current limiting circuit that outputs a second current limiting signal when the outputs exceeds the predetermined level.

14 Claims, 6 Drawing Sheets

STABILIZED POWER SUPPLY UNIT HAVING A CURRENT LIMITING FUNCTION

FIELD OF THE INVENTION

The invention relates to a stabilized power supply unit having a current limiting function for maintaining at a constant level the output voltage supplied to a load if the output current to the load has changed, and restricting excessive output current to the load.

BACKGROUND OF THE INVENTION

A stabilized power supply unit having a current limiting function is widely used in a series regulator serving as a convenient power supply unit and a constant voltage charging apparatus for charging a battery.

FIG. 5 shows a circuit structure of a series regulator having a conventional current limiting function.

The series regulator shown in FIG. 5 is composed of a voltage control circuit 10, an output circuit 20, and a current limiting circuit 30, integrated on an IC chip.

The voltage control circuit 10 is provided with a differential amplifier Amp and voltage dividing resistors R11 and R12. The differential amplifier Amp is provided at one input terminal thereof (inverting input) with a reference voltage Vref for setting an output voltage, and at another input terminal thereof (non-inverting input) with an output feedback voltage Vfb obtained by dividing the output voltage by the voltage dividing resistors R11 and R12. The difference between the two inputs is amplified by the differential amplifier Amp, and outputted from the voltage control circuit 10 as a control voltage Vc. The differential amplifier Amp is supplied with a constant current from a constant current source 11.

The output circuit 20 has an output transistor Q21 consisting of a p-type MOS transistor (hereinafter referred to as p-type transistor) connected between a power source potential Vdd and the output terminal Po of the power supply unit. The control voltage Vc is applied to the gate of the output transistor Q21. Connected to the output terminal Po is a load Lo and a condenser Co for stabilizing the output to the load.

The current limiting circuit 30 includes a p-type current detection transistor Q31 and a detection resistor R31 connected in series in the order mentioned between the power source potential Vdd and the ground. The current limiting circuit 30 is also provided with an n-type MOS transistor (hereinafter referred to as n-type transistor) Q32 having a gate impressed with the voltage drop across the resistor R31. Constant voltage control function of the voltage control circuit 10 is regulated by the operating condition of the n-type transistor Q32.

The detection transistor Q31 is formed together with the output transistor Q21 on the same IC chip with a predetermined ratio in size less than 1 as compared with the output transistor Q21. The gate of the n-type transistor Q31 is impressed with the same control voltage Vc as the gate voltage of the output transistor Q21. As a consequence, a detection current Io' which is practically proportional (e.g. 1/100) to the output current Io flowing through the output transistor Q21 flows through the n-type transistor Q31. The voltage drop across the detection resistor R31 by the detection current Io' determines the operating condition of the n-type transistor Q32. The threshold voltage of the n-type transistor Q32 is set to the voltage that corresponds to the output current (i.e. load current) Io being a preset over-current protection level Is0. The threshold voltage is determined by the ratio of the output current Io and the detection current Io', the resistance of the detection resistor R31, and properties of the n-type transistor Q32.

Operation of the conventional series regulator will be described with reference to FIG. 6, which shows a characteristic relationship between the output voltage Vo and output current Io of the regulator. Under normal operating condition in which the output current Io is below the limit of over-current, the voltage control circuit 10 outputs a control voltage Vc so as to equalize the output feedback voltage Vfb with the reference voltage Vref. This control voltage Vc is applied to the gate of the output transistor Q21 of the output circuit 20 to bring the output voltage Vo to a predetermined set voltage Vs. In this way, the constant voltage control of the regulator can be maintained stable at all times regardless of the magnitude of output current Io, unless the output current Io reaches the preset over-current protection level Is0.

Under such stable condition, the voltage drop by the detection resistor R31 due to the detection current Io' does not reach the threshold voltage of the n-type transistor Q32. Hence, nothing affects the constant voltage control function of the regulator.

However, as the output current Io reaches the preset over-current protection level Is0, the voltage drop across the detection resistor R31 reaches the operating threshold voltage of the n-type transistor Q32. Thus, the n-type transistor Q32 enabled as the output current Io exceeds the preset over-current protection level Is0. In the voltage control circuit 10, current limiting operation is prioritized, so that the output voltage falls quickly, almost vertically. In this sense, this over-current protection function is a drop-type characteristic. The current level Is1 at which the output voltage fully drops down to Vo is slightly higher than the preset over-current protection level Is0, in accordance with the gain (control gain) of the current limiting regulator. The region above the level Is0 is an over-current region.

In this way, under normal condition the output voltage Vo is controlled to be at a preset voltage Vs. However, if the output current exceeds a predetermined level (over-current protection level Is0), the output current Io is automatically limited.

Hence, the output transistor Q21 must have a capability to continuously provide the maximum current Is1 in the over-current region $\alpha$, exceeding the preset over-current protection level Is0. Therefore, a series regulator preferably has as small over-current region $\alpha$ as possible, which is ideally zero from the point of design of series regulator.

However, in general there is provided a stabilizing condenser Co at the output end of the series regulator. Then, if the over-current region a is too small, inrush current to the condenser Co will cause an oscillation at the time of startup. In other words, output transistor Q21 is perfectly conductive at the time of startup since the voltage across the condenser Co, and hence the output voltage Vo, is then zero and this causes (or tends to cause) a large inrush current to flow into the condenser. As the inrush current is detected, the current limiting circuit 30 is caused to turn off the output transistor Q21. At this stage, the output transistor Q21 is again perfectly conductive, since the output voltage Vo is still substantially zero. This permits a large inrush current to flow, thereby causing the current limiting circuit 30 to operate again. In this manner, the control of the series regulator is lost, creating an oscillation in the circuit, which hinders a smooth rise of output voltage Vo. In addition, this oscillation can disadvantageously give adverse influence (e.g. vibrations) on other components of the series regulator, and can be a source of noises to peripheral devices.

Alternatively, the current limiting circuit 30 can be of a slow-response type having a sufficient margin for oscillation. In this case, although oscillations are avoided, inrush current during a startup cannot be avoided. Therefore, it presents another problem that the condenser Co and the output transistor Q21 will be deteriorated by the inrush current.

SUMMARY OF THE INVENTION

It is, therefore, an object of the invention to provide a stabilized power supply unit having a current limiting function that is capable of: furnishing a steep drop-type over-current protection characteristic to minimize the over-current region of; preventing oscillations during a startup of the power supply unit; and limiting inrush current within a predetermined range during the startup.

In accordance with one aspect of the invention, there is provided a stabilized power supply unit, comprising:

a voltage control circuit for outputting a voltage control signal in accord with the difference between a reference voltage and an output feedback voltage associated with the output voltage of the power supply unit;

an output circuit for outputting the output voltage under the control of the voltage control signal; and a current limiting circuit for generating a current limiting signal when the output current of the output circuit exceeds a predetermined level, wherein the current limiting circuit includes:

a first slow-response type current limiting circuit for generating a first current limiting signal; and a second quick-response type current limiting circuit, having a lower gain than the first current limiting circuit, for generating a second current limiting signal, the current limiting signal, consisting of the first and second current limiting signals, controls the voltage control signal so as to limit the output current approximately to a predetermined level.

In accordance with another aspect of the invention, there is provided a stabilized power supply unit, comprising:

a voltage control circuit for outputting a voltage control signal in accord with the difference between an output feedback voltage associated with the output voltage of the power supply unit and a reference voltage;

an output circuit for outputting the output voltage under the control of the voltage control signal; and a current limiting circuit for generating a current limiting signal when the output current of the output circuit exceeds a predetermined level, wherein the current limiting circuit includes:

an output current detection circuit for detecting the output current and generating an output current detection signal upon detection of the output current;

a first slow-response type signal generation circuit for generating a first current limiting signal;

a second quick-response type signal generation circuit, having a lower gain than that of said first current limiting circuit, for generating a second current limiting signal; and a selection circuit for selecting, upon receipt of a switching signal, either one of the first and second signal generation circuits to be supplied with the output current detection signal, the selection circuit adapted to select the second signal generation circuit during a predetermined period after a startup of the power supply unit, and otherwise to select the first signal generation circuit; and wherein the first and second current limiting signals constitute a current limiting signal to control the voltage control signal so as to limit said output current approximately to a predetermined level.

The output circuit of the invention has an output transistor arranged between a power source and the output terminal of the output circuit, the output transistor adapted to be controlled by a voltage control signal, thereby providing a constant output voltage. The current limiting circuit has a current detection transistor of the same type and the same conduction-type as the output transistor, and is configured to obtain a detection current having a level proportional to the output current by controlling the current detection transistor by a voltage control signal.

In accordance with the invention, the first high-gain, slow-response type current limiting circuit is enabled to acquire a steep drop-type over-current protection characteristic to minimize the over-current region of the power supply unit, should the load current has increased to a predetermined level under normal operating condition, thereby reducing the over-current tolerance of the output transistor substantially to the predetermined limiting level. On the other hand, when an inrush current flows into a condenser connected to the output of the power supply unit, the second low-gain quick-response type current limiting circuit is enabled, preventing oscillations during a startup and limiting the inrush current within a prescribed range.

In the first and second current limiting circuits, current detecting elements (e.g. resistors) are not included, since output current is detected by a current detection transistor controlled by a voltage control signal. Hence, the output circuit will not suffer an increased voltage drop or power loss at all, even when two current limiting circuits are included.

A high-gain, low-response first current limiting signal and a low-gain, quick-response second current limiting signal can be generated in a simple manner using only resistors and condenser, or resistors only.

DETAILED DESCRIPTION OF THE PREFERRED EMBODIMENTS

Figure 1:
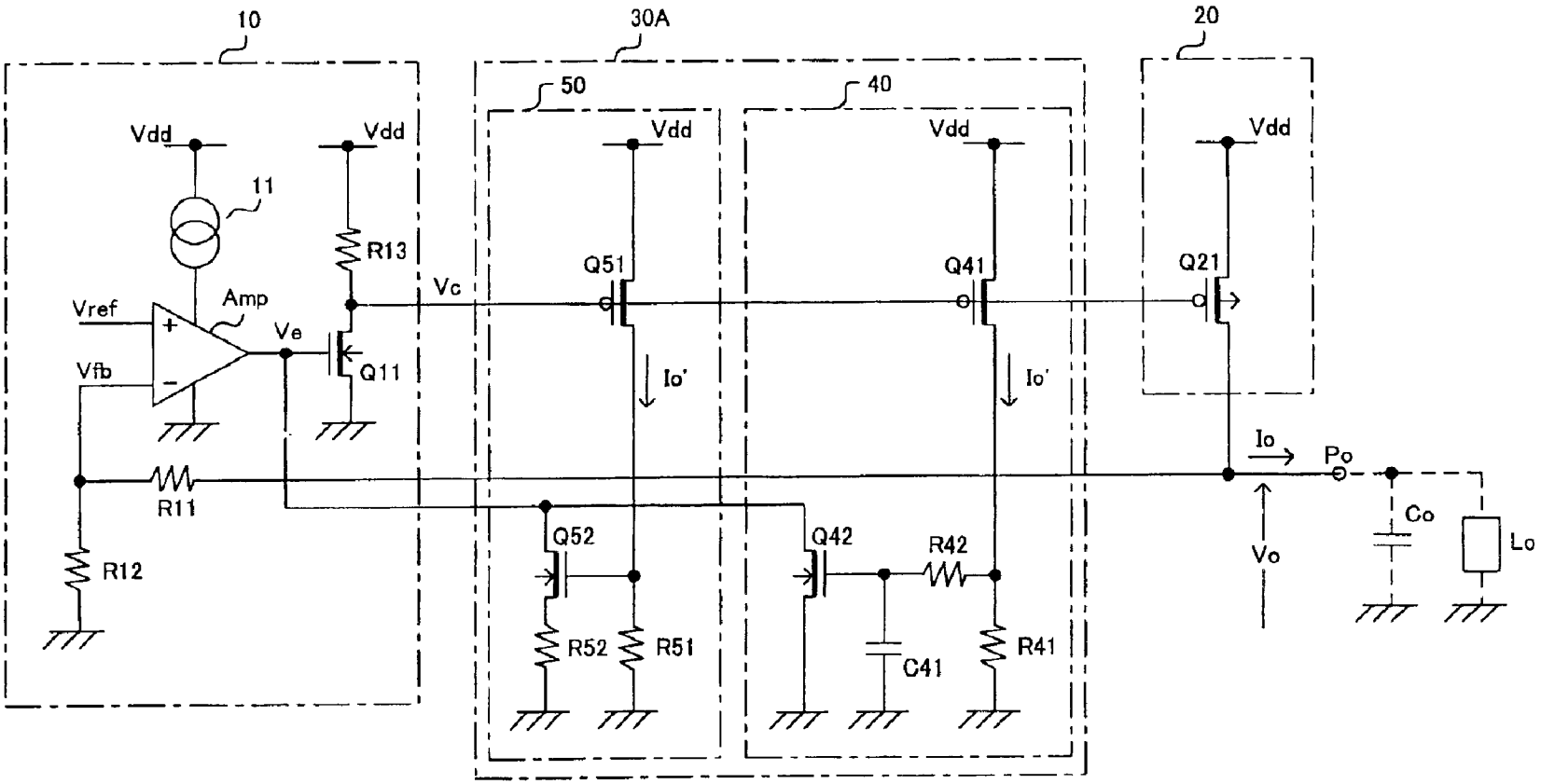
FIG. 1 shows a circuit arrangement of a series regulator in accordance with a first embodiment of the invention.
Figure 2:
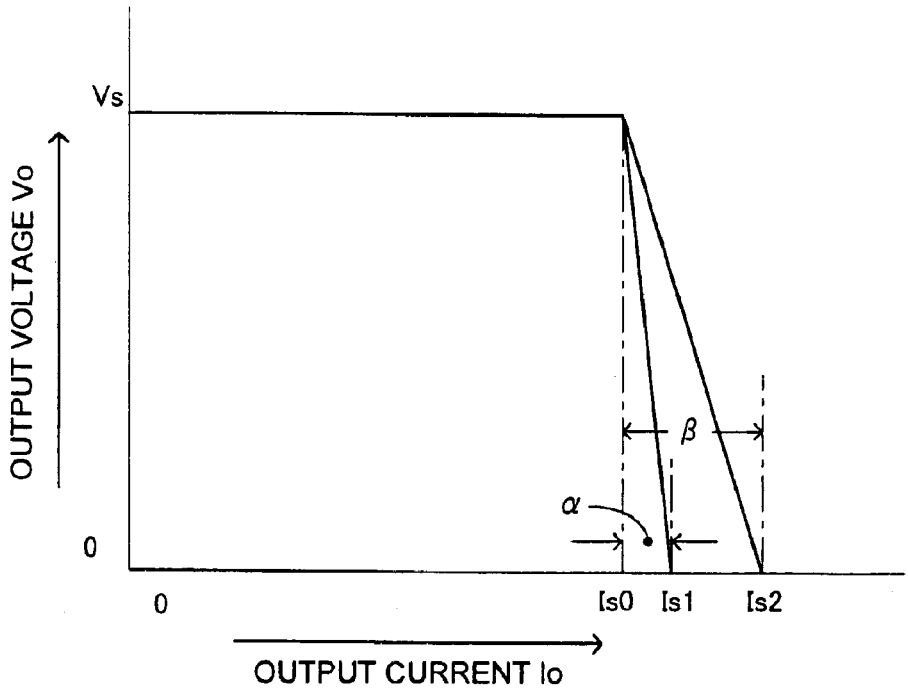
FIG. 2 is a graph showing output voltage—output current characteristic of the series regulator shown in FIG. 1.
Figure 3:
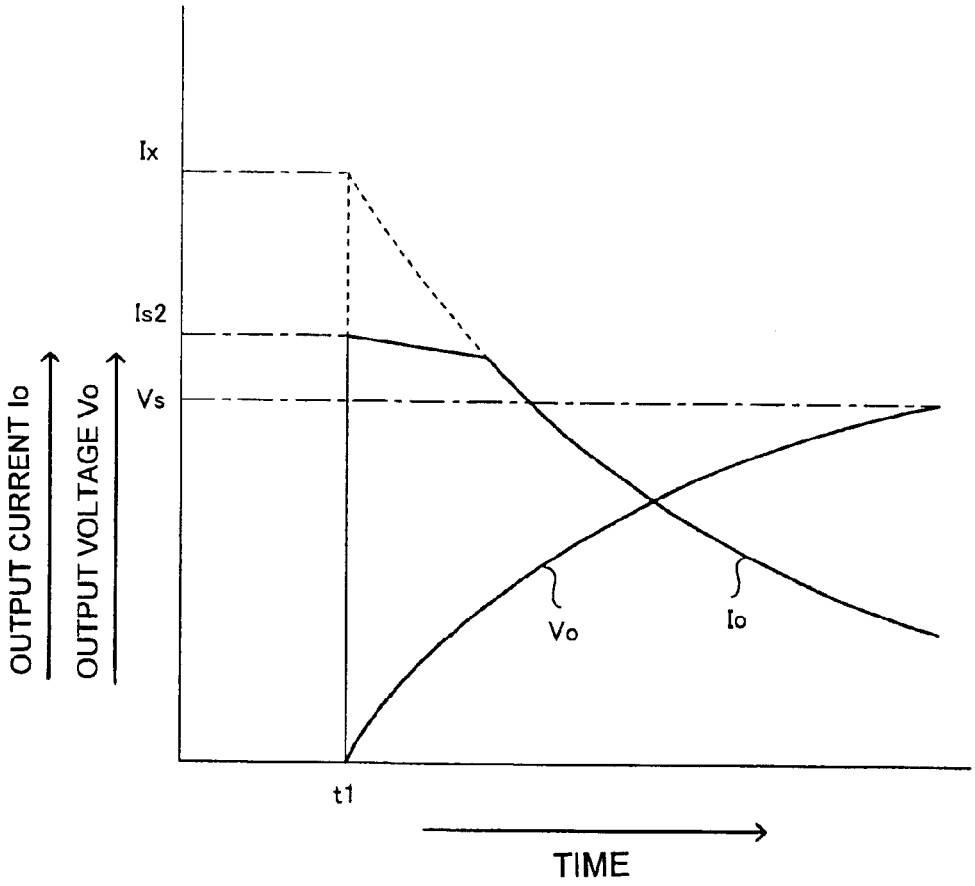
FIG. 3 is a graph showing time rate of change in output voltage and in output current during a startup of the series regulator of this invention.

The invention will now be described in detail by way of examples with reference to accompanying drawings. FIG. 1 shows a circuit arrangement of a series regulator in accordance with a first embodiment of the invention. FIG. 2 shows the output voltage Vo versus output current Io characteristic of the series regulator. FIG. 3 shows a time rate of change in output voltage Vo as a function of output current Io during a startup of the series regulator.

Series regulator shown in FIG. 1 is composed of a voltage control circuit 10, an output circuit 20, and a current limiting circuit 30A, all formed on an IC chip.

The voltage control circuit 10 is provided with a differential amplifier Amp and voltage dividing resistors R11 and R12. One input (non-inverting input) of the differential amplifier Amp is supplied with a reference voltage Vref for setting up an output voltage, while the other input (inverting input) is supplied with an output feedback voltage Vfb generated by dividing the output voltage by the voltage dividing resistors R11 and R12. The difference between the two inputs is amplified by the differential amplifier Amp. The amplified output Ve of the differential amplifier Amp is applied to the gate of an n-type transistor Q11 which is connected in series to a resistor R13 as shown. Output from the drain of the n-type transistor Q11 is a voltage control signal (hereinafter referred to as control voltage) Vc, which results from the inversion of the amplified output Ve. The amplified output Ve is controlled by the current limiting signal issued from the current limiting circuit 30A. A current source 11 supplies a constant current to the voltage control circuit 10.

The output circuit 20 is provided with an output transistor Q21 in the form of a p-type transistor connected between a power supply potential Vdd and an output terminal Po. The control voltage Vc is applied to the gate of output transistor Q21. Connected to the output terminal Po are a load Lo and a condenser Co for stabilizing the output.

The current limiting circuit 30A is composed of a first current limiting circuit 40 and a second current limiting circuit 50 for respectively generating a first and the second current limiting signals.

The first current limiting circuit 40 includes a p-type current detecting transistor Q41 and a detection resistor R41, connected in series in the order mentioned, between the power supply potential Vdd and the ground. The detection resistor R41 is connected in parallel with a series circuitry of a resistor R42 and a condenser C41 to output a first current detection signal from the node of the resistor R42 and condenser C41. These resistors R41 and R42 and the condenser C41 together constitute means for forming a current detection signal.

Figure 5:
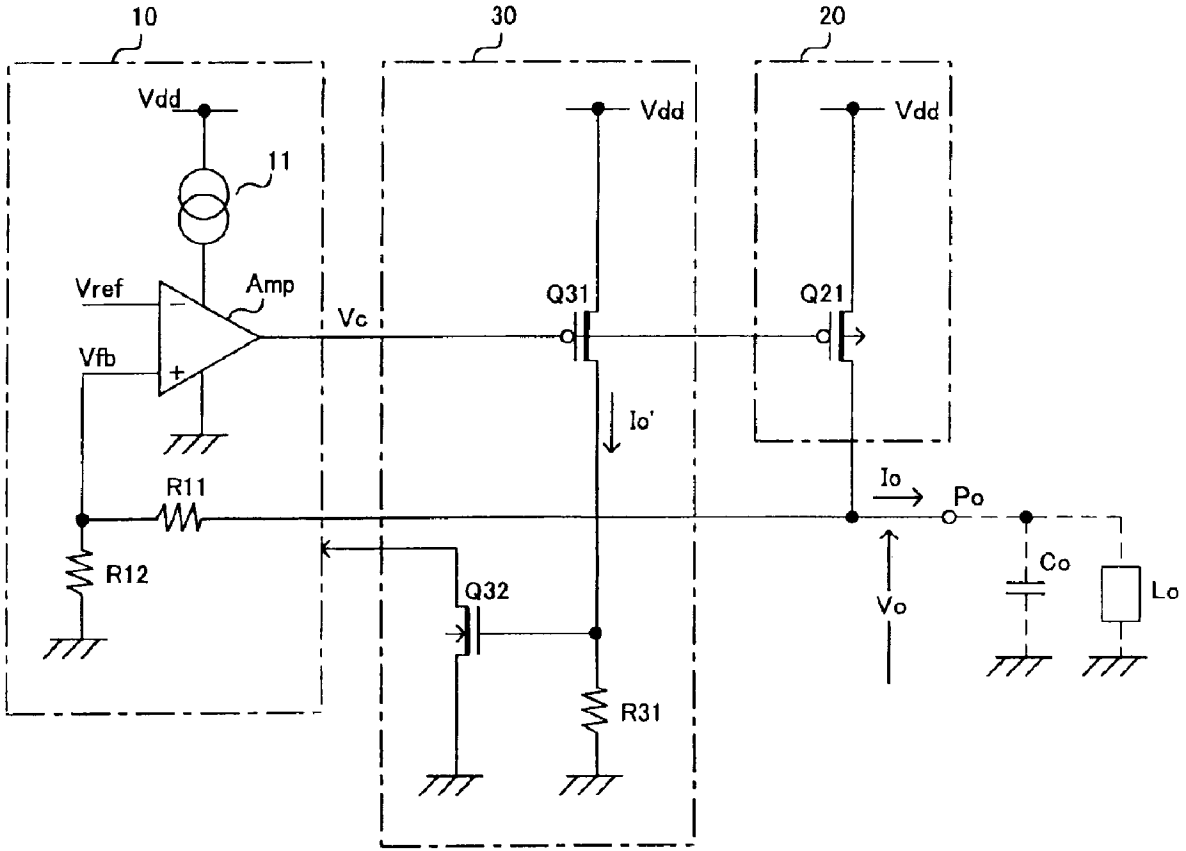
FIG. 5 PRIOR ART
FIG. 5 shows a conventional series regulator having a current limiting function.
Figure 6:
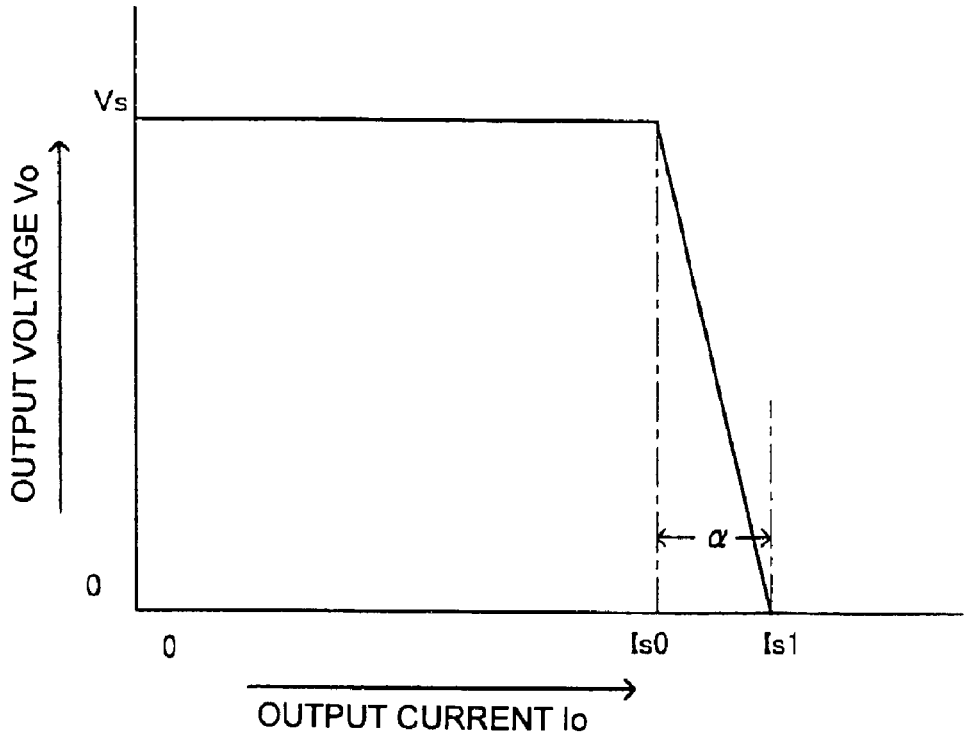
FIG. 6 PRIOR ART
FIG. 6 is a graph showing an output voltage—output current characteristic of a conventional series regulator.

A detection transistor Q41 is similar to a conventional detection transistor Q31 as shown in FIG. 5. As a consequence, a detection current Io' proportional to the output current Io flowing through the output transistor Q21 flows through a low-pass filter composed of the resistors R41 and R42 and the condenser C41. Hence, the first current detection signal lags behind (the change of) detection current Io'.

An n-type transistor Q42 is connected between the output terminal of the differential amplifier Amp and the ground for generating the first current limiting signal. The first current detection signal is applied to a point between the gate and the source of the transistor Q42. The first current limiting signal is outputted from the n-type transistor Q42 in accordance with the operating status thereof. Hence, the first current limiting circuit 40 has a high gain and a slow response.

The second current limiting circuit 50 includes a p-type current detection transistor (referred to as detection transistor) Q51 and a detection resistor R51 constituting means for generating a current detection signal, connected in series in the order mentioned and connected between the power supply potential Vdd and the ground.

The detection transistor Q51 has the same structure as the detection transistor Q41. Hence, a detection current Io' proportional to the output current Io flows through the resistor R51. Therefore, the second current detection signal responds to the detection current Io' immediately, with no delay. It is noted that the magnitudes of the detection currents Io' that flows through the respective detection transistors Q41 and Q51 need not be the same.

An n-type transistor Q52 for generating the second current limiting signal and a resistor R52 are connected in the series between the output terminal of differential amplifier Amp and the ground. The second current detection signal is applied to a point between the gate of n-type transistor Q52 and resistor R52 (i.e. a point between the gate and the ground). The second current limiting signal in accord with the operational status of the n-type transistor Q52 is outputted therefrom. In this way, the second current detection signal is impressed across a point between the gate and the sources of the n-type transistor Q52 and the resistor R52, so that the second current limiting circuit 50 has a low gain and a quick response, in contrast to the first current limiting circuit 40.

An overall current limiting signal is formed of the first current limiting signal and the second current limiting signal coupled together. The amplified output Ve of the differential amplifier Amp is adjusted by the overall current limiting signal.

Operation of the series regulator shown in FIG. 1 will now be described with reference to FIG. 2 showing the output voltage Vo versus output current Io characteristic and FIG. 3 showing the time rate of change in the output voltage Vo and in the output current Io during a startup.

Under normal operating condition, the output current Io remains below the over-current level, and then the voltage control circuit 10 operates in the same way as the conventional one shown in FIG. 5. Therefore, a stable operating condition of the circuit continues, maintaining constant voltage operation, irrespective of the magnitude of the output current Io, until the output current Io reaches an over-current protection level Is0.

Under this condition, too, detection current Io' flows in detection transistor Q41 of the first current limiting circuit 40 and the detection transistor Q51 of the second current limiting circuit 50. However, the voltage drops across the respective detection resistors R41 and R51 will not affect the constant voltage control, since the voltage drops have not reached the threshold voltage of the n-type transistors Q42 and Q52.

If, however, as the load increases under normal operating condition, the output current Io can reach the over-current protection level Is0, and the voltage drop by the detection resistor R41 of the first current limiting circuit 40 may become the threshold voltage of the n-type transistor Q42. In this case, the output current Io will not increase significantly that the voltage across the condenser C41 increases with the voltage drop across the detection resistor R41. Thus, as the output current Io exceeds the over-current protection level Is0, the n-type transistor Q42 is enabled to generate the first current limiting signal.

By enabling the n-type transistor Q42, the amplified output Ve of the differential amplifier Amp is lowered, which in turn causes the control voltage Vc to increase. As a consequence, the output transistor Q21 operates with a limited conductivity, resulting in a drop of the output voltage Vo. Thus, the output current Io is limited.

The second current limiting circuit 50 has a faster response than the first current limiting circuit 40, but has a small gain. Therefore, under this condition, when the output current Io increases only slowly, the operation of the second current limiting circuit 50 is masked by the behavior of the first current limiting circuit 40, so that the second current limiting signal will not be generated.

In this way, in the voltage control circuit 10, the current limiting action is performed by the first current limiting circuit 40 at high-gain, and output voltage Vo falls quite steeply, almost vertically. In this case, the current Is1 that brings the output voltage Vo to zero is larger only slightly than the over-current protection level Is0, since the current limiting gain (control gain) of the circuit 40 is high. Since the over-current region a can be set small, the output transistor Q21 suffices to have a capability of continuously providing a current as much as the substantial over-current protection current Is0.

Next, operation of the regulator encountering an inrush current to the condenser Co during a startup will now be described.

At the beginning of a start up, the voltage impressed across the condenser Co is zero, so that the output voltage Vo is also substantially zero. As the regulator becomes operative and an inrush current flows into the condenser Co, currents Io' flows through the transistor Q41 of first current limiting circuit 40 and the transistor Q51 of the second current limiting circuit 50, the current Io' being proportional to the magnitude of the inrush current.

Although the first current limiting circuit 40 has a high gain, it cannot respond to the inrush current, since the circuit is of a slow-response type.

On the other hand, the second current limiting circuit 50 is of a quick response type, though it has a low gain. As a consequence, when the output current Io' proportional to the inrush current exceeds a preset level Is2 (which is set a little (by the amount of β) above the over-current protection level Is0), the n-type transistor Q52 is promptly enabled to generate a second current limiting signal.

The n-type transistor Q52 lowers the amplified output Ve of the differential amplifier Amp which in turn causes the control voltage Vc to be increased accordingly. Thus, the conductivity of the output transistor Q21 becomes limited, the output voltage Vo is lowered, and the output current Io limited.

As shown in FIG. 3, at the startup time t1, the output current Io will be limited to a lower current level Is2 than the current level Ix (shown by a dotted line in the figure) that would be reached by the output current if the current were not limited. Subsequently, as the condenser Co is charged, the output voltage Vo slowly rises to the preset voltage Vs and the output current Io gradually decreases to the required level of the load current.

Because the second current limiting circuit 50 is configured to be a low-gain, quick-response type circuit, output current Io is limited as it exceeds the preset current level Is2, slightly above Is0 and Is1. Therefore, the generation of the oscillation caused by this current limiting can be avoided.

It will be understood that in the embodiment shown in FIG. 1, should short-circuiting occur on the side of a load during a normal operation of the series regulator, a first current limiting action would be taken immediately by the second current limiting circuit 50 to limit the output current to Is2, and then a secondly current limiting action a little later by the first current limiting circuit 40 to limit the current to Is1. Thus, the circuit will be well protected against short-circuiting.

Figure 4:
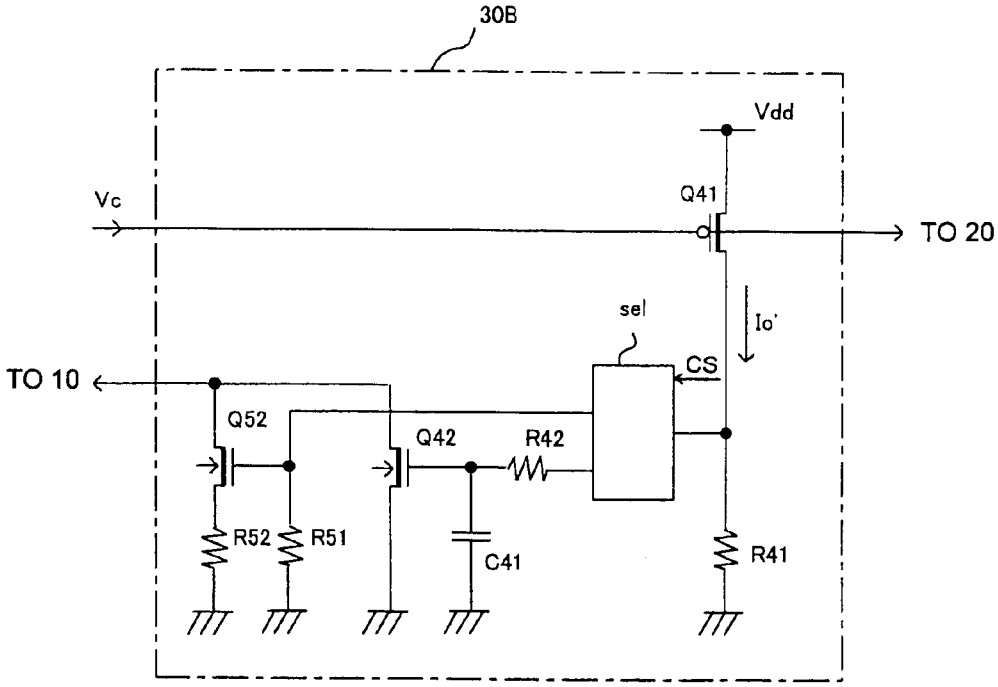
FIG. 4 shows a circuit arrangement of a series regulator in accordance with a second embodiment of the invention.

FIG. 4 shows a current limiting circuit 30B in accordance with another embodiment of the invention. The voltage control circuit 10 and the output circuit 20 shown in FIG. 4 are the same as the corresponding circuits of FIG. 1.

As seen in FIG. 4, a current limiting circuit 30B only differs from the current limiting circuit 30A of FIG. 1 in that a selector Sel is provided in FIG. 4 in place of the current detection transistor Q51 of FIG. 1.

The selector Sel is adapted to selectively apply the voltage drop created by the detection resistor R41 to the first high-gain, slow-response type current limiting circuit or the second low-gain, quick-response type current limiting circuit.

The selection, or switching, of the two current limiting circuits is carried out such that the second current limiting circuit is selected during a startup, and the first current limiting circuit is selected under a normal operating condition. Now that a startup signal is externally supplied to the stabilized power supply unit at the time of its startup, this selection can be accomplished by utilizing the startup signal as a switching signal CS. For example, the second low-gain, quick-response type current limiting circuit may be selected by the selection signal CS for a given period of time after the startup.

It will be understood that this switching provides the same current limiting capability as the first embodiment shown in FIG. 1.

It is noted that, in limiting the output current Io, the same current limiting function may be obtained by regulating either the reference voltage Vref or the output feedback voltage Vfb using the current limiting signal of the current limiting circuit 30A or the current limiting circuit 30B, instead of controlling the amplified output voltage Ve.

To do so, a separate constant-current circuit may be provided such that the level of the constant current is controlled using the current limiting signal. By supplying the regulated current to either one of the voltage diving resistors R11 and R12, the output feedback voltage Vfb can be regulated. Alternatively, an offset voltage that can be varied in accordance with the current limiting signal may be added to, or subtracted from, the reference voltage Vref or the output feedback voltage Vfb. In this way, current limiting function can be attained on the input side of the differential amplifier Amp by controlling the reference voltage Vref or the output feedback voltage Vfb.

Thus, it is possible to avoid an incidence that the differential amplifier Amp reaches its upper limit (or saturation) of amplification, thereby ensuring a smooth recovery of normal operating condition from an over-current limiting condition.

What we claim is:

1. A stabilized power supply unit, comprising:

a voltage control circuit for outputting a voltage control signal in accord with the difference between an output feedback voltage associated with the output voltage of said power supply unit and a reference voltage;

an output circuit for outputting said output voltage under the control of said voltage control signal; and a current limiting circuit for generating a current limiting signal when the output current of said output circuit exceeds a predetermined level, wherein said current limiting circuit includes:

a first slow-response type current limiting circuit for generating a first current limiting signal; and a quick-response type second current limiting circuit having a lower gain than that of said first current limiting circuit, for generating a second current limiting signal, and said current limiting signal, consisting of said first and second current limiting signals, controls said voltage control signal so as to limit said output current approximately to said predetermined level.

2. The stabilized power supply unit according to claim 1, wherein said output circuit has an output transistor connected between a power source and the output terminal of said power supply unit, said output transistor adapted to be controlled by said voltage control signal so as to output a constant output voltage.

3. The stabilized power supply unit according to claim 2, wherein each of said first and second current limiting circuits has a current detection transistor of the same type and same conduction type as said output transistor, each of said current detection transistors controlled by said voltage control signal to output a detection current proportional to said output current.

4. The stabilized power supply unit according to claim 3, wherein said first current limiting circuit includes a first current detection signal formation circuit for generating, in response to the detection current of said current detection transistor, a first current detection signal lagging behind said current detection current, and a first current limiting signal generation transistor, impressed with said first current detection signal as a control signal, in such a way that said first current limiting circuit generates a first high-gain, slow-response type current limiting signal;

second current limiting circuit includes a second current detection signal formation circuit capable of promptly generating a second current detection signal in response to the detection current of said current detection transistor, and a series circuitry of a second current limiting signal generation transistor impressed with said second current detection signal as a control signal and a resistor, in such a way that said second current limiting circuit generates a second low-gain, quick-response type current limiting signal.

5. The stabilized power supply unit according to claim 4, wherein said first current detection signal formation circuit has a delay detection circuit including at least one resistor and a condenser, outputting the voltage across said condenser as said first current detection signal;

said second current detection signal formation circuit has a detection circuit including at least one resistor, outputting the voltage drop across said resistor as said second current detection signal.

6. The stabilized power supply unit according to claim 1, wherein said voltage control circuit has a differential amplifier for amplifying the difference between said output feedback voltage and said reference voltage and outputting said voltage control signal in accord with said difference, and said current limiting signal is coupled to said voltage control circuit to regulate the amplified output of said differential amplifier.

7. The stabilized power supply unit according to claim 1, wherein said voltage control circuit has a differential amplifier for amplifying the difference between said output feedback voltage and said reference voltage and outputting said voltage control signal in accord with said difference, and said current limiting signal is coupled to said voltage control circuit to regulate either one of said output feedback voltage and said reference voltage.

8. A stabilized power supply unit, comprising:

a voltage control circuit for outputting a voltage control signal in accord with the difference between an output feedback voltage associated with the output voltage of said power supply unit and a reference voltage;

an output circuit for outputting said output voltage under the control of said voltage control signal; and a current limiting circuit for generating a current limiting signal when the output current of said output circuit exceeds a predetermined level, wherein said current limiting circuit includes;

an output current detection circuit for detecting said output current to generate an output current detection signal;

a first slow-response type signal generation circuit for generating a first current limiting signal;

a second quick-response type signal generation circuit, having a lower gain than that of said first current limiting circuit, for generating a second current limiting signal; and a selection circuit for selecting, upon receipt of a switching signal formed based on a startup signal, either one of said first and second signal generation circuits to be supplied with said output current detection signal, said selection circuit adapted to select said second signal generation circuit during a predetermined period subsequent to a startup of said power supply unit, and otherwise to select said first signal generation circuit, and wherein said first and second current limiting signals constitute a current limiting signal to control said voltage control signal so as to limit said output current approximately to said predetermined level.

9. The stabilized power supply unit according to claim 8, wherein said output circuit has an output transistor connected between a power source and the output terminal of said power supply unit, said output transistor adapted to be controlled by said voltage control signal so as to output a constant output voltage.

10. The stabilized power supply unit according to claim 9, wherein said output current detection circuit has a current detection transistor of the same type and same conduction type as said output transistor, said current detection transistor controlled by said voltage control signal to output said output current detection signal proportional to said output current.

11. The stabilized power supply unit according to claim 10, wherein said first signal generation circuit includes a first current detection signal formation circuit for generating, in response to the detection current of said current detection transistor, a first current detection signal lagging behind said detection current, and a first current limiting signal generation transistor, impressed with said first current detection signal as a control signal, in such a way that said first signal generation circuit generates a first high-gain, slow-response type current limiting;

second current limiting circuit includes:

a second current detection signal formation circuit capable of promptly generating a second current detection signal in response to the detection current of said current detection transistor, and a series circuitry of a second current limiting signal generation transistor impressed with said second current detection signal as a control signal and a resistor, in such a way that said second signal generation circuit generates a second low-gain, quick-response type current limiting signal.

12. The stabilized power supply unit according to claim 11, wherein said first current detection signal formation circuit has a delay detection circuit including at least one resistor and a condenser, outputting the voltage across said condenser as said first current detection signal;

said second current detection signal formation circuit has a detection circuit including at least one resistor, outputting the voltage drop across said resistor as said second current detection signal.

13. The stabilized power supply unit according to claim 8, wherein said voltage control circuit has a differential amplifier for amplifying the difference between said output feedback voltage and said reference voltage and outputting said voltage control signal in accord with said difference, and said current limiting signal is coupled to said voltage control circuit to regulate the amplified output of said differential amplifier.

14. The stabilized power supply unit according to claim 8, wherein said voltage control circuit has a differential amplifier for amplifying the difference between said output feedback voltage and said reference voltage and outputting said voltage control signal in accord with said difference, and said current limiting signal is coupled to said voltage control circuit to regulate either one of said output feedback voltage and said reference voltage.

* * * * *